US005999137A

United States Patent [19]

Crosby

[11] Patent Number: 5,999,137

[45] Date of Patent: Dec. 7, 1999

[54] INTEGRATED ANTENNA SYSTEM FOR SATELLITE TERRESTRIAL TELEVISION RECEPTION

[75] Inventor: Jeffrey W. Crosby, Sherman Oaks, Calif.

[73] Assignee: Hughes Electronics Corporation, El Segundo, Calif.

[21] Appl. No.: 08/607,676

[22] Filed: Feb. 27, 1996

[51] Int. Cl.[6] ..... H01Q 21/00

[52] U.S. Cl. ..... 343/725; 343/727; 343/729; 343/873

[58] Field of Search ..... 343/725, 727, 343/726, 729, 730, 873, 872; H01Q 21/00

[56] References Cited

U.S. PATENT DOCUMENTS

| | | | |
|---|---|---|---|
| 2,846,678 | 8/1958 | Best | 343/727 |
| 3,500,419 | 3/1970 | Leitner et al. | 343/725 |
| 4,400,701 | 8/1983 | Dupressoir | 343/725 |
| 5,483,663 | 1/1996 | Tawil | 455/3.2 |
| 5,604,508 | 2/1997 | Atkinson | 343/725 |
| 5,708,963 | 1/1998 | Mobley et al. | 455/12.1 |

FOREIGN PATENT DOCUMENTS

| | | | |
|---|---|---|---|
| 58-103205 | 6/1983 | Japan | 343/725 |

*Primary Examiner*—Hoanganh Le
*Attorney, Agent, or Firm*—John A. Crook; Michael W. Sales

[57] ABSTRACT

An integrated antenna system for satellite and VHF/UHF reception is provided. The elements of a VHF/UHF antenna are embedded in a satellite antenna. The satellite and VHF/UHF signals are combined and transmitted on a single cable to the receiver. The receiver splits the signals. A switch within the receiver unit for displaying either the VHF/UHF or satellite transmissions is provided. The receiver also powers amplifiers at the antenna using the single cable.

9 Claims, 1 Drawing Sheet

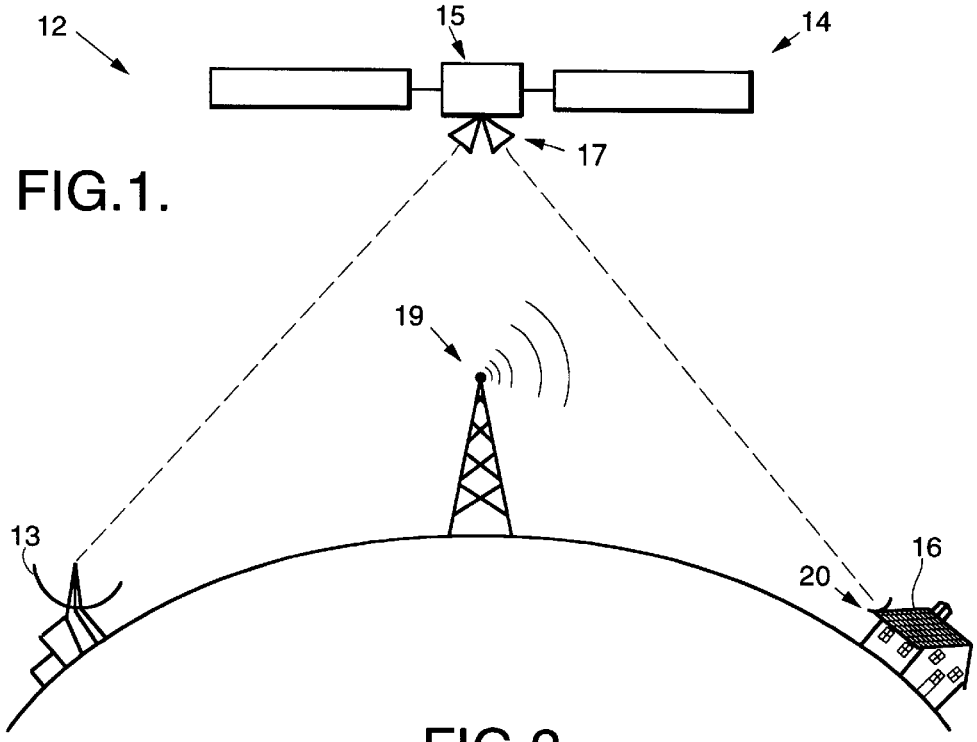
FIG.1.
FIG.2.
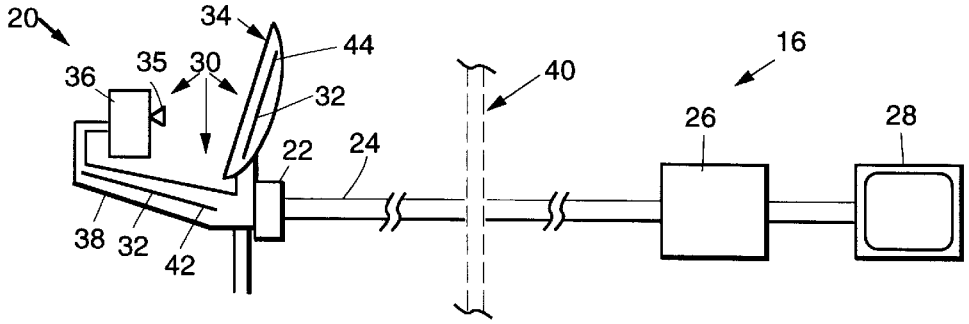
FIG.3.
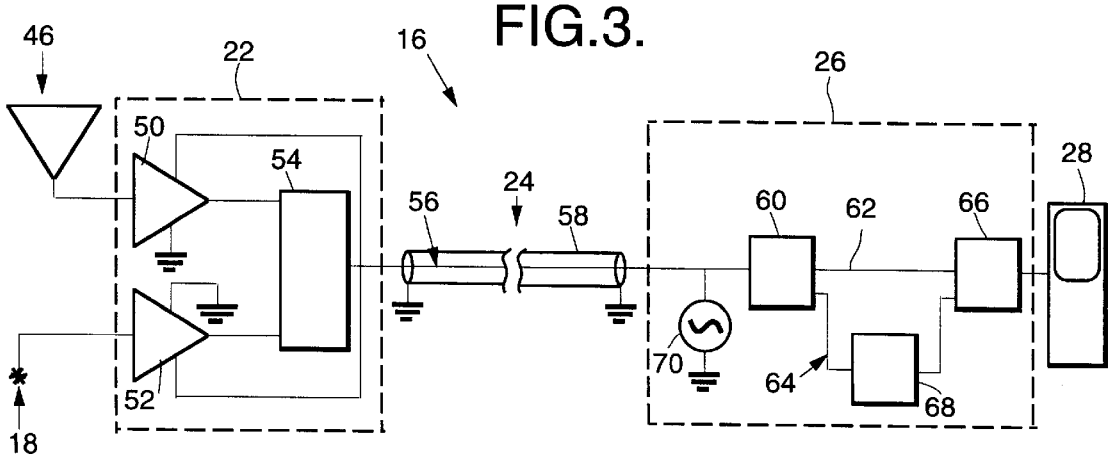

INTEGRATED ANTENNA SYSTEM FOR SATELLITE TERRESTRIAL TELEVISION RECEPTION

BACKGROUND OF THE INVENTION

The present invention relates generally to satellite communications systems. More particularly, the invention relates to a system and method for receiving satellite and VHF/UHF transmission through one coaxial cable from a single reception device.

Generally, in digital satellite communications systems, a ground-based transmitter beams a forward error coded uplink signal to a satellite positioned in a geosynchronous orbit. The satellite relays the signal back to a ground-based receiver antenna in a separate location. Direct broadcast satellite ("DBS") systems allow households to receive television, audio, data and video directly from the DBS satellite. Each household subscribing to the system receives the broadcast signals through a satellite dish antenna and a receiver unit.

In the typical DBS system, the satellite receiver antenna includes an 18-inch parabolic dish, and the receiver unit is a television set-top decoder module, or "IRD". The satellite receiver antenna is mounted outside the house, and a coaxial cable is provided to link the satellite receiver antenna to the indoor IRD and television.

Presently available DBS systems do not transmit the subscriber's local television stations. Thus, each household subscribing to a DBS system needs a separate VHF/UHF antenna with a separate coaxial cable in order to receive local channels, including local news. The IRD usually has multiple coaxial inputs to allow a user to switch the television display from one coaxial input to another, like from the satellite signal to the VHF/UHF signal. However, the required extra antenna takes up space, is unsightly, adds additional costs, and adds wind drag when mounted onto the satellite receiver antenna.

Therefore, there is a need for a system and method for providing one antenna for receiving both satellite and VHF/UHF signals, transmitting both signals on a single coaxial cable and splitting the signals in the IRD so that a user may select which signal to televise.

SUMMARY OF THE INVENTION

The present invention provides a system and method for receiving satellite signals and VHF/UHF signals on the same device at a satellite receiver station. The system comprises a satellite antenna having a dish, a feedhorn support and an output signal. A VHF/UHF antenna is embedded in the satellite antenna. The satellite dish and feedhorn support receive the satellite signal, and the embedded VHF/UHF antenna receives the VHF/UHF signal.

In another aspect of the invention, a system and method for combining VHF/UHF signals and satellite signals received at a satellite receiver station is provided. The satellite antenna has a satellite output signal, and the VHF/UHF antenna has a VHF/UHF output signal. A device is provided for combining the satellite output signal and the VHF/UHF signal, and a cable is provided for forwarding the combined signal to downstream components.

In another aspect of the invention, a system and method for receiving and using a combined VHF/UHF and satellite signal at a receiver unit of a satellite receiver station is provided. A cable carrying the combined signal is connected to the receiver. Within the receiver is a splitting device which operatively connects to the cable. The splitting device has at least two outputs. One output is connected to a satellite signal tuner which is, in turn, connected to a switch, and the second output is also operatively connected to the switch. The combined signal is split into a VHF/UHF signal and a satellite signal. The receiver outputs either the VHF/UHF signal or the satellite signal based on the switch setting.

It is to be understood that both the foregoing general description and the following detailed description are exemplary and are intended to provide further explanation of the invention as claimed. The invention, together with further objects and attendant advantages, will be best understood by reference to the following detailed description in conjunction with the attached drawings.

BRIEF DESCRIPTION OF THE DRAWINGS

FIG. 1 illustrates a direct-to-home DBS satellite television system and a conventional local television broadcast system. The illustrated system incorporates a satellite-VHF/UHF receiver antenna embodying the present invention.

FIG. 2 is a ground based subscriber station with a more detailed illustration of the combined satellite-VHF/UHF antenna shown in FIG. 1.

FIG. 3 is an electrical schematic of the ground based subscriber station of FIG. 2.

DETAILED DESCRIPTION OF THE PRESENTLY PREFERRED EMBODIMENTS

Referring now to the drawings, and more particularly to FIG. 1, a digital DBS system and local television broadcast system 12 of the present invention is shown. The DBS system preferably includes a ground-based broadcast transmitter 13, a space segment 14 that includes a satellite 15, and a ground-based subscriber receiving station 16. In an exemplary DBS system, the satellite 15 is a geosynchronous satellite, such as the Hughes® H HS-601™ spacecraft, positioned at a geosynchronous orbital location at approximately 101° W longitude. The home subscriber receiving station 16 includes an outdoor satellite-VHF/UHF receiver antenna 20 connected to an indoor integrated receiver/decoder ("IRD") (not shown) via a cable (also not shown).

The broadcast transmitter 13 receives digitally modulated television or audio signals and beams them at 17.3–17.8 GHz to the satellite 15. The satellite 15 translates the signals to 12.2–12.7 Ghz, then beams them to the receiver antenna 20 of the receiving station 16 for subsequent demodulation. The satellite 15 transmits downlink signals via on-board transponders 17 operating at a power level of 120 to 240 watts. For a typical DBS system, the air uplink to the satellite has a 24 Mhz band rate, a 20 M symbols forward/Sec Symbol rate, and a 40 Mbps total bit rate.

The local television broadcast system includes a local broadcast transmitter 19 and a receiver antenna 20. The local broadcast transmitter transmits a signal using the NTSC system capable of display by television sets (not shown). Television broadcast VHF signals are transmitted in the 54 to 216 MHz range (leaving a gap from 88 to 174 MHz for standard FM band broadcasts and another gap at 72 to 76 MHz). Each VHF channel is given a 6 MHz bandwidth. Television broadcast UHF signals are transmitted in the 470 to 806 MHz range. Each UHF channel is also typically given a 6 MHz bandwidth.

Referring to FIG. 2, a ground-based subscriber receiving station 16 is shown. The receiving station 16 includes an outdoor satellite-VHF/UHF receiver antenna 20, a circuitry box 22, a cable 24, a receiver unit 26 and a television 28.

The receiver antenna 20 has a satellite antenna, generally shown at 30, and a VHF/UHF antenna, generally shown at 32. The satellite antenna 30 includes a parabolic dish 34, a feedhorn 35, a Low-Noise Block ("LNB") 36 and a feedhorn support 38. The dish 34 and the support 38 are preferably made out of an RF transparent material. Fiberglass is the preferred material, but other materials such as resins may be used. Fiberglass is RF transparent and reflects satellite signals, therefore it is an effective material to use for the dish 34. Alternatively, the dish 34 may be made out of graphite or other non-RF transparent materials. The dish 34 is then coated, either entirely or just a portion, with an RF transparent material.

The parabolic dish 34 receives satellite signals and focuses those signals by reflecting them to the feedhorn 35. The feedhorn 35 is a waveguide positioned at the focal point of the dish 34 to receive the reflected focused signals and is well known in the art. The feedhorn 35 directs the concentrated signals to a probe (not shown) which responds to the focused signals by producing a small electrical signal. Preferably, the feedhorn 35 has a generally circular cross-section for receiving DBS system circularly polarized signals. The LNB 36 receives the signals from the feedhorn probe. The LNB 36 amplifies and down converts the signals to a 1 GHz general range, and transmits the satellite signals via circuit box 22 and cable 24 to the receiver unit 26.

The cable 24 is preferably an RG-6 coaxial cable, but other cables may be used. The cable 24 typically runs from the receiver antenna 20 through the wall of a structure, generally shown at 40. The IRD 26 is located inside the structure.

The receiver antenna 20 also has a VHF/UHF antenna 32. Within the support 38 is a first element 42 of the VHF/UHF antenna 32. A second element 44 of the VHF/UHF antenna 32 is embedded on the dish 34. The VHF/UHF antenna is preferably made of metal for reception of VHF/UHF signals, as known in the art. First element 42 in the support 38 is preferably completely covered by the support 38, so that it does not add any wind drag to the receiver antenna 20. However, a portion of element 42 may extend beyond the surface of the support 38 while still being embedded in the support 38. Second element 44 embedded within the dish 34 is also preferably entirely within the dish. However, element 44 may extend past the surface of the dish 34 while a portion of element 44 is embedded in the dish 34. Where a non-RF transparent dish 34 is used, the second element 44 is embedded in the coating of RF transparent materials on dish 34. The coating may create a ridge or other structure sufficient to hold second element 44 away from the non-RF transparent materials to allow proper reception by the second element 44. An entire element 42 or 44 may be outside satellite antenna 32, as long as at least a portion of element 42 or 44 is embedded within satellite antenna 32. Preferably, element 44 does not distort the parabolic surface of dish 34 that reflects the satellite signals to the LNB 36. Further, the VHF/UHF antenna 32 may be embedded within any RF transparent material used on receiver antenna 20. Further, the VHF/UHF antenna 32 may be embedded along the surface of any RF transparent component of the receiver antenna 20.

Referring to FIG. 3, the satellite signal received by satellite antenna 30 is transmitted to a circuit box 22 through an input 48. The VHF/UHF signal received by VHF/UHF antenna 32 is likewise transmitted to the circuit box 22 through an input 46. The circuit box 22 may be located anywhere along the cable 24. Preferably, the circuit box 22 is located on the receiver antenna 20 so that minimal noise is introduced before signal amplification and less cabling is required to get the two different signals to the circuit box 22. Within the circuit box 22, the VHF/UHF signal is fed to an amplifier 50, which amplifies the VHF/UHF signal to reduce noise effects. Likewise, the satellite signal is fed to an amplifier 52, which may be located either in the circuit box 22 or the LNB 36 as is known in the art. Power for the amplifiers may be provided by any external means, but preferably by connection to the cable 24 as discussed below.

The amplified VHF/UHF signal and the amplified satellite signal are then transmitted to a combining device 54. The combining device 54 is preferably a passive device, such as a diplexer. The combining device 54 must operate over a wide frequency range, preferably 40 MHz to 2,000 MHz. Such diplexers are available from "Channel Master" or "DSI." The diplexer maintains the frequency and time properties of the input signals. Multiple passive filters act to balance the signals in the diplexer. The combining device could comprise any other device capable of combining the two signals, like a modulator.

The combining device 54 outputs the combined signal onto cable 24. In particular, outer sheath 58 of cable 24 is grounded so that the entire signal carried within the cable 24 will be fully reflected, as is well known by a person skilled in the art. The combined signal is placed on the inner conductor 56 of cable 24 and transmitted on cable 24 to IRD or receiver 26.

Alternatively, the VHF/UHF signal may be combined with the satellite signal before the VHF/UHF signal is amplified. An amplifier capable of operating over a 40 MHz to 2,000 MHz range would amplify the combined signal.

The combined signal from the cable 24 is transmitted within the receiver unit 26 to a splitter 60. The splitter 60 is preferably a passive device and in particular a diplexer. This diplexer may be the same type of diplexer used in the combining device 54. The diplexer comprises multiple passive filters. The multiple outputs of the diplexer will each contain both of the differing frequency signals input into combining device 54. However, the splitter 60 may be any device capable of splitting the VHF/UHF signal from the satellite signal, such as a demodulator in the case of a modulated combined signal. The splitter 60 splits the signal into a VHF/UHF signal and a satellite signal. The VHF/UHF signal is transmitted on output 62 to switch 66. The splitter 60 transmits the satellite signal on output 64 to satellite tuner decoder 68. Satellite tuner decoder 68 is known by a person skilled in the art and is preferably the unit used by Thomson Consumer Electronics or RCA in their IRDs of their respective DBS satellite receiver stations. The tuner decoder 68 outputs a satellite signal capable of being displayed on television 28. That satellite signal is transmitted to switch 66. Depending on the setting of switch 66, the VHF/UHF signal is transmitted to the television 28, or the satellite signal is transmitted to the television 28. A user may operate switch 66 in any manner known in the art, including a switch on the receiver unit 26 or by infrared remote control for the receiver unit 26. In that manner, the user may select between viewing the transmissions from a local broadcast or the transmission from a satellite broadcast on television 28.

Preferably, within the receiver unit 26, a power source 70 is connected to inner conductor 56 of cable 24. The power source 70 may provide either a DC or an AC power signal. Preferably, the power source 70 provides DC power. The power source 70 also supplies a 13 or 17 volt polarity selection to the LNB 36 (not shown) for operation of the satellite antenna 30. The power source 70 also provides power to the amplifiers 50 and 52 for their operation. The power source 70 connects to the inner conductor 56 of the cable 24. At the circuit box 22, the inputs to amplifiers 50 and 52 are connected in parallel to the inner conductor 56. Any other devices needing power may also be connected in parallel to inner conductor 56. Parallel connection allows the 13/17 polarity voltage to be maintained for operation of the LNB 36. Due to the polarity selection voltage differential, the amplifiers 50 and 52 must be capable of a 13 to 17 volt range power inputs. Amplifiers 50 and 52 must also be capable of operation with the combined signal connected with the power inputs. The power is provided through the cable 24 which also carries the combined signal. If needed, a power input may have a filter for removing the combined signal. The power source 70 must be able to provide the wattage required to operate the amplifiers 50 and 52, and other circuitry in the LNB, such as the polarization selection and satellite signal downconverting circuitry.

If an AC signal is used, then the signal is preferably a 60 Hz signal. Preferably a filter would then be provided at the LNB 36 to remove the 60 Hz signal for proper operation of the satellite antenna 30.

Both a satellite signal and a VHF/UHF signal may be received at the receiver antenna 20. Both signals are then combined and transmitted over cable 24 to receiver unit 26. Receiver unit 26 also provides power on the same cable 24 from power source 70 to the amplifiers 50 and 52. The receiver unit 26 then splits the satellite and VHF/UHF signals. The satellite tuner decoder 68 then transforms the satellite signal so that it may be displayed by television 28. Through user selection of a switch 66, local stations or satellite broadcast stations may be viewed by a user in a system which requires only one connection to the receiver antenna 20.

Of course, it should be understood that a wide range of changes and modifications can be made to the preferred embodiment described above. For example, varying locations of the power source may be used. The system may be made integral with the receiver unit or may be sold as an addition. Thus, it is intended that the foregoing detailed description be regarded as illustrative rather than limiting.

It is the following claims, including all equivalents, which are intended to define the scope of this invention.

I claim:

1. A system for receiving satellite signals and VHF/UHF signals comprising:

a satellite antenna and a VHF/UHF antenna, said satellite antenna comprising a material that reflects the satellite signals, a dish and a feedhorn support, and wherein part of the VHF/UHF antenna is embedded in the feedhorn support and part of the VHF/UHF antenna is embedded in the dish; and said VHF/UHF receiving antenna at least partially embedded in said material of the satellite antenna for receiving terrestrial UHF/VHF signals, whereby said material is substantially transparent to the VHF/UHF signals.

2. A system for receiving satellite signals and VHF/UHF signals comprising:

a satellite antenna and a VHF/UHF antenna, said satellite antenna comprising a material that reflects the satellite signals, a dish and a feedhorn support, and wherein part of the VHF/UHF antenna is embedded in the feedhorn support and part of the VHF/UHF antenna is embedded in the dish, the dish and feedhorn support are generally radio frequency transparent; and a VHF/UHF receiving antenna at least partially embedded in said material of the satellite antenna for receiving terrestrial UHF/VHF signals, whereby said material is substantially transparent to the VHF/UHF signals.

3. A system for receiving both satellite and terrestrial television signals comprising:

a satellite antenna for receiving at least one satellite television broadcast, said satellite antenna includes a reflector element and a feedhorn support; and a terrestrial antenna for receiving at least one television broadcast, said terrestrial antenna at least partially embedded with said satellite antenna, a first portion of said terrestrial antenna is embedded in said feedhorn support, and a second portion of said terrestrial antenna is embedded in said reflector element.

4. A television receiving antenna for receiving both satellite signals and terrestrial signals, comprising:

a satellite antenna having a reflector portion and a feedhorn support portion; and a terrestrial antenna for receiving terrestrial television signals, said terrestrial antenna is substantially embedded in both of said reflector portion and said feedhorn support portion.

5. A television receiving antenna for receiving both satellite signals and terrestrial signals, comprising:

a satellite antenna having a reflector portion and a feedhorn support portion; and a terrestrial antenna for receiving terrestrial television signals, said terrestrial antenna is fully embedded in both of said reflector portion and said feedhorn support portion.

6. A system for receiving satellite signals and VHF/UHF signals, comprising:

a satellite antenna having a dish and a feedhorn support; and a VHF/UHF antenna at least partially embedded in the satellite antenna, wherein part of said VHF/UHF antenna is embedded in said feedhorn support and part of said VHF/UHF antenna is embedded in said dish.

7. A system for receiving satellite signals and VHF/UHF signals as recited in claim 6, wherein said dish and feedhorn support are generally radio frequency transparent.

8. A television receiving antenna for receiving both satellite signals and terrestrial signals, comprising:

a satellite antenna having a reflector portion and a feedhorn support portion; and a terrestrial antenna for receiving terrestrial television signals, said terrestrial antenna is substantially embedded in both of said reflector portion and said feedhorn support portion.

9. A television receiving antenna for receiving both satellite signals and terrestrial signals as recited in claim 8, wherein said terrestrial antenna is fully embedded in both of said reflector portion and said feedhorn support portion.

* * * * *